US005537477A

United States Patent [19]

Gauthier et al.

[11] Patent Number: 5,537,477

[45] Date of Patent: Jul. 16, 1996

[54] FREQUENCY CHARACTERISTIC SHAPING CIRCUITRY AND METHOD

[75] Inventors: Edouard A. Gauthier, West Chester; J. William Mauchly, Berwyn, both of Pa.

[73] Assignee: Ensoniq Corporation, Malvern, Pa.

[21] Appl. No.: 503,879

[22] Filed: Jul. 18, 1995

Related U.S. Application Data

[63] Continuation of Ser. No. 192,863, Feb. 7, 1994, abandoned.

[51] Int. Cl.[6] ..... H04R 25/00

[52] U.S. Cl. ..... 381/68.2; 381/106; 333/14

[58] Field of Search ..... 381/68, 68.2, 68.4, 381/98, 103, 104, 106; 333/14, 28 R, 123, 129, 132

[56] References Cited

U.S. PATENT DOCUMENTS

| | | | |
|---|---|---|---|
| 3,518,678 | 6/1970 | Lawrence et al. . | |
| 3,744,015 | 7/1973 | Marimon et al. . | |
| 3,842,190 | 12/1974 | Brenin | 333/28 R |
| 3,919,657 | 11/1975 | Howlett et al. . | |
| 3,958,213 | 5/1976 | Scott et al. . | |
| 4,051,331 | 9/1977 | Strong et al. . | |
| 4,064,480 | 12/1977 | Howlett . | |
| 4,084,148 | 4/1978 | Koshikawa . | |
| 4,099,035 | 7/1978 | Yanick . | |
| 4,118,604 | 10/1978 | Yanick . | |
| 4,490,843 | 12/1984 | Bose et al. . | |
| 4,517,415 | 5/1985 | Laurence . | |
| 4,622,440 | 11/1986 | Slavin . | |
| 4,622,692 | 11/1986 | Cole . | |
| 4,641,344 | 2/1987 | Kasai et al. . | |
| 4,680,798 | 7/1987 | Neumann . | |
| 4,703,506 | 10/1987 | Sakamoto et al. . | |
| 4,712,244 | 12/1987 | Zwicker et al. . | |
| 4,725,950 | 2/1988 | Woods . | |
| 4,726,067 | 2/1988 | Alonso . | |
| 4,736,433 | 4/1988 | Dolby . | |
| 4,747,142 | 5/1988 | Tofte . | |
| 4,779,055 | 10/1988 | Beauducel et al. . | |
| 4,803,732 | 2/1989 | Dillon . | |
| 4,815,142 | 3/1989 | Imreh . | |
| 4,837,832 | 6/1989 | Fanshel . | |
| 4,926,159 | 5/1990 | Bartlett . | |
| 5,046,102 | 9/1991 | Zwicker et al. . | |
| 5,151,702 | 9/1992 | Urkowitz . | |
| 5,195,140 | 3/1993 | Kudo et al. . | |
| 5,210,709 | 5/1993 | Tani et al. . | |
| 5,214,709 | 5/1993 | Ribic . | |
| 5,255,320 | 10/1993 | Ribic . | |

*Primary Examiner*—Curtis Kuntz
*Assistant Examiner*—Huyen D. Le
*Attorney, Agent, or Firm*—Ratner & Prestia

[57] ABSTRACT

Frequency characteristic shaping circuitry having a plurality of bandpass filters to which an audio signal is supplied and a plurality of variable gain attenuators individually associated with the bandpass filters. The output signals of the variable gain attenuators are supplied to a pair of summing circuits, one providing a sum of the attenuator output signals and the other providing an inverted version of the sum of the attenuator output signals. The sum of the attenuator output signals and the inverted version of the sum of the attenuator output signals are combined in a final summing circuit. In another aspect of the present invention, each bandpass filter has a second variable gain attenuator and the output signals of these attenuators are supplied to another pair of summing circuits, one providing a sum of these attenuator output signals and the other providing an inverted version of the sum of these attenuator output signals. The sum of these attenuator output signals and the inverted version of the sum of these attenuator output signals are combined in a another final summing circuit. The outputs of the two final summing circuits are sampled over variable periods of time determined by the loudness level of the audio signal supplied to the bandpass filters.

10 Claims, 1 Drawing Sheet

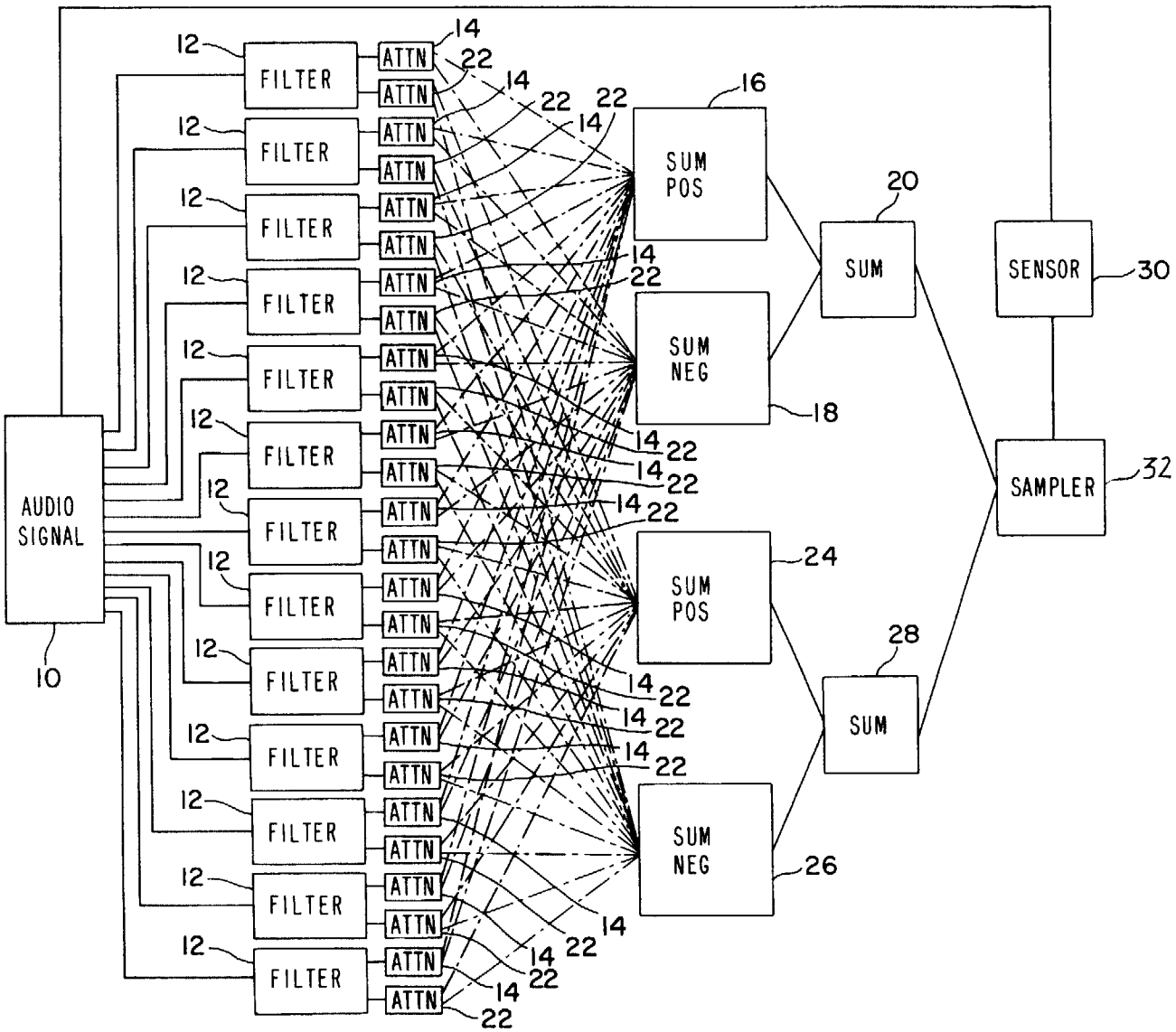
SENSOR
30
SAMPLER
32
SUM
20
SUM
28
SUM POS
16
SUM NEG
18
SUM POS
24
SUM NEG
26
ATTN
14
22
FILTER
12
AUDIO SIGNAL
10

FREQUENCY CHARACTERISTIC SHAPING CIRCUITRY AND METHOD

This application is a continuation of application Ser. No. 08/192,863 filed Feb. 7, 1994, abandoned.

TECHNICAL FIELD

The present invention relates, in general, to improving the frequency characteristics of audio equipment and, in particular, to circuitry which permits greater variations in developing the desired frequency characteristic of a hearing aid and adaptation of a hearing aid to the loudness level of the sound picked up by the hearing aid.

BACKGROUND OF THE INVENTION

A number of state-of-the-art hearing aids are arranged with a plurality of bandpass filters so that the hearing aid can be fitted with an overall frequency characteristic suitable to overcome the particular hearing loss of the individual who will use the hearing aid. Each bandpass filter has a distinct frequency band characteristic which overlaps with adjacent frequency band characteristics for individually passing components of an audio signal originating at the sound pick-up of the hearing aid and having frequencies falling within the frequency band characteristic of the bandpass filter. By providing means for setting the gain of each frequency channel as part of the fitting procedure, for example, with a plurality of attenuators individually associated with the plurality of bandpass filters, the overall frequency characteristic is established with each channel being set according to the particular hearing loss of the individual who will use the hearing aid.

The degree of variation, or "custom fitting," of the overall frequency characteristic, however, is limited. The lower limits of the overall frequency characteristic are at the points where the individual frequency characteristics of the different channels intersect.

Another shortcoming of certain multi-channel state-of-the-art hearing aids is that they provide inadequate compensation for variations in the loudness of the sounds picked up by the hearing aids. It is common practice to set the hearing aid such that the amplification varies depending upon the loudness of the sound picked up by the hearing aid. This feature is provided because the louder the sounds, the more the hearing capability of the user of the hearing aid approaches normal hearing. Without any change in the amplification of the hearing aid and with the amplification being set for low sound levels, the user will experience too much amplification of high loudness sounds picked up by the hearing aid.

The desired gain at any loudness level is dependent upon frequency. The desired overall frequency characteristic at low loudness is likely to be different from the desired overall frequency characteristic at high loudness. Typically, the state-of-the-art hearing aids provide only an approximation of the desired "loudness characteristic (i.e. gain v. frequency at low loudness levels to frequency at high loudness levels) because the control is not effected on a frequency-by-frequency or frequency band-by-frequency band (i.e. individual channel) basis. In most such hearing aids, the control is effected independent of frequency. For example, certain hearing aids are arranged with a variable gain amplifier, common to all the frequency channels, at either the inputs to the bandpass filters or at the outputs from the bandpass filters, so that compression provided by such an amplifier, at either the inputs to or the outputs from the bandpass filters, is common to the entire frequency range of the hearing aid.

SUMMARY OF THE INVENTION

A bipolar equalizer circuit, constructed in accordance with the present invention, includes means for supplying an audio signal and a plurality of bandpass filters each responsive to the audio signal and having a distinct frequency band characteristic which overlaps with adjacent frequency band characteristics for individually passing components of the audio signal having frequencies falling within the frequency band characteristic of the bandpass filter. Also included in this bipolar equalizer circuit is a first plurality of attenuators each individually associated with one of the plurality of bandpass filters and having an individually selectable gain for individually controlling the amplitude of the components of the audio signal individually passed by the associated bandpass filter to provide a first plurality of output signals. This bipolar equalizer circuit further includes first and second summing circuits. The first summing circuit combines a first group of the first plurality of output signals to provide a first composite signal having a first composite frequency characteristic determined by: (a) the frequency band characteristics of those bandpass filters associated with those attenuators of the first plurality of attenuators from which the first group of the first plurality of output signals are provided, and (b) the individually selected gains of those attenuators of the first plurality of attenuators from which the first group of the first plurality of output signals are provided. The second summing circuit inverts a second group of the first plurality of output signals and combines the inverted output signals of the first plurality of output signals to provide a second composite signal having a second composite frequency characteristic determined by: (a) the frequency band characteristics of those bandpass filters associated with those attenuators of the first plurality of attenuators from which the second group of the first plurality of output signals are provided, and (b) the individually selected gains of those attenuators of the first plurality of attenuators from which the second group of the first plurality of output signals are provided. Also included in this bipolar equalizer circuit is a third summing circuit for combining the first composite signal and the second composite signal to provide a final output signal having a final composite frequency characteristic which is the sum of the first composite frequency characteristic and the second composite frequency characteristic.

The bipolar equalizer circuit summarized above can be applied in a compression/expansion circuit in accordance with a second aspect of the present invention. Such a compression/expansion circuit includes the bipolar equalizer circuit summarized above with the gains of the plurality of attenuators selected so that the first and second composite signals have composite frequency characteristics corresponding to a predetermined loudness level of the audio signal, for example a high loudness level of the audio signal. Thus, the third summing circuit provides a final high loudness composite signal having a final high loudness composite frequency characteristic which is the sum of the first high loudness composite frequency characteristic and the second high loudness composite frequency characteristic. In addition, this compression/expansion circuit includes a second plurality of attenuators each individually associated with one of the plurality of bandpass filters and having an individually selectable gain for individually controlling the amplitude of the components of the audio signal individually passed by the associated bandpass filter to provide a second plurality of output signals. This compression/expansion circuit also includes fourth and fifth summing circuits. The fourth summing circuit combines a first group of the second plurality of output signals to provide a first low loudness composite signal having a first low loudness composite frequency characteristic determined by: (a) the frequency band characteristics of those bandpass filters associated with those attenuators of the second plurality of attenuators from which the first group of the second plurality of output signals are provided, and (b) the individually selected gains of those attenuators of the second plurality of attenuators from which the first group of the second plurality output signals are provided. The fifth summing circuit inverts a second group of the second plurality of output signals and combines the inverted output signals of the second plurality of output signals to provide a second low loudness composite signal having a second low loudness composite frequency characteristic determined by: (a) the frequency band characteristics of those bandpass filters associated with those attenuators of the second plurality of attenuators from which the second group of the second plurality of output signals are provided, and (b) the individually selected gains of those attenuators of the second plurality of attenuators from which the second group of the second plurality of output signals are provided. The compression/expansion circuit further includes a sixth summing circuit for combining the first low loudness composite signal and the second low loudness composite signal to provide a final low loudness output signal having a final low loudness composite frequency characteristic which is the sum of the first low loudness composite frequency characteristic and the second low loudness composite frequency characteristic. Also included in this compression/expansion circuit are means for sensing the loudness level of the audio signal and means responsive to the sensing means for sampling the final high loudness composite signal and the final low loudness composite signal over variable periods of time related to the loudness level of the audio signal to develop a final output signal having an amplitude related to the loudness of audio signal.

BRIEF DESCRIPTION OF THE DRAWING

The single FIGURE is a block diagram of a bipolar equalization circuit constructed in accordance with the present invention and a compression/expansion circuit constructed in accordance with the present invention.

DETAILED DESCRIPTION OF THE INVENTION

Referring to the drawing, a bipolar equalizer circuit, constructed in accordance with the present invention, includes means for supplying an audio signal.

Such means, represented by the block identified by reference numeral 10, can be the circuitry which delivers an amplified version of the sound picked up by a hearing aid.

The bipolar equalizer circuit also includes a plurality of bandpass filters 12 each responsive to the audio signal and having a distinct frequency band characteristic which overlaps with adjacent frequency band characteristics. For the embodiment of the invention being described, there are thirteen bandpass filters arranged with the following pass bands: 1 OCT 178 Hz; 1/2 OCT 338 Hz; 1/2 OCT 588 Hz; 1/2 OCT 776 Hz; 1/2 OCT 1.04 KHz; 1/3 OCT 1.44 KHz; 1/2 1.8 KHz; 1/3 2.3 KHz; 1/3 2.9 KHz; 1/3 3.6 KHz; 1/3 4.6 KHz; 1/3 5.8 KHz; and 1/3 7.2 KHz. Bandpass filters 12 individually pass components of audio signal having frequencies falling within the frequency band characteristics of the bandpass filters.

The bipolar equalizer circuit further includes a plurality of attenuators 14 each individually associated with one of the plurality of bandpass filters 12. Each attenuator 14 has an individually selectable gain for individually controlling the amplitude of the components of the audio signal individually passed by the associated bandpass filter 12 to provide a first plurality of output signals.

The output signals from attenuators 14 are supplied to a first summing circuit 16 which combines a first group of these output signals to provide a first composite signal having a first composite frequency characteristic determined by: (a) the frequency band characteristics of those bandpass filters 12 associated with those attenuators 14 from which the first group of the output signals from the attenuators are provided, and (b) the individually selected gains of those attenuators 14 from which the first group of the output signals from the attenuators are provided. The designation POS in block 16 indicates that this summing circuit simply sums the first group of the output signals provided by attenuators 14.

The output signals from attenuators 14 also are supplied to a second summing circuit 18 which inverts a second group of these output signals and combines the inverted output signals to provide a second composite signal having a second composite frequency characteristic determined by: (a) the frequency band characteristics of those bandpass filters 12 associated with those attenuators 14 from which the second group of output signals from the attenuators are provided, and (b) the individually selected gains of those attenuators 14 from which the second group of output signals from the attenuators are provided. The designation NEG in block 18 indicates that this summing circuit both inverts and sums the second group of the output signals provided by attenuators 14.

A bipolar equalizer circuit further includes a third summing circuit 20 for combining the first composite signal developed by summing circuit 16 and the second composite signal developed by summing circuit 18 to provide a final output signal having a final composite frequency characteristic which is the sum of the first composite frequency characteristic and the second composite frequency characteristic. The "negative" frequency characteristic, when added to the "positive" frequency characteristic in summing circuit 20, can bring the lower limits down further because the "negative" frequency characteristic is out of phase with the "positive" frequency characteristic, making possible considerably greater variations in the overall frequency characteristic of the hearing aid than possible with state-of-the-art hearing aids.

Summing circuits 16 and 18 can be programmed to select which of the output signals provided by attenuators 14 will be included in the first group and combined by summing circuit 16 and which of the output signals provided by attenuators 14 will be included in the second group and inverted and combined by summing circuit 18. Alternatively, the selection of the output signals provided by attenuators 14 for inclusion in the two groups can be done on a trial and error basis by examination of the final composite frequency characteristic of the final output signal provided by summing circuit 20 and varying the gains of attenuators 14 and changing the compositions of the groups of signals until the final composite frequency characteristic of the final output signal corresponds to what is desired.

The bipolar equalizer circuit described above can be applied in a compression/expansion circuit in accordance with a second aspect of the present invention. Such a compression/expansion circuit includes the bipolar equalizer circuit described above with the gains of the plurality of attenuators selected so that the first and second composite signals have composite frequency characteristics corresponding to a predetermined loudness level of the audio signal, for example a high loudness level of the audio signal. Thus, the third summing circuit provides a final high loudness composite signal having a final high loudness composite frequency characteristic which is the sum of the first high loudness composite frequency characteristic and the second high loudness composite frequency characteristic.

In addition, such a compression/expansion circuit includes a second bipolar equalization circuit which is similar to the one described above. This second bipolar equalization circuit includes a second plurality of attenuators 22 each individually associated with one of the plurality of bandpass filters 12. Each attenuator 22 has an individually selectable gain for individually controlling the amplitude of the components of the audio signal individually passed by the associated bandpass filter 12 to provide a second plurality of output signals.

The output signals from attenuators 22 are supplied to a fourth summing circuit 24 for combining a first group of the second plurality of output signals to provide a first low loudness composite signal having a first low loudness composite frequency characteristic determined by: (a) the frequency band characteristics of those bandpass filters 12 associated with those attenuators 22 from which the first group of the output signals of attenuators 22 are provided, and (b) the individually selected gains of those attenuators 22 from which the first group of the output signals of attenuators 22 are provided. The designation POS in block 24 indicates that this summing circuit simply sums the first group of the output signals provided by attenuators 22.

The output signals from attenuators 22 also are supplied to a fifth summing circuit 26 which inverts a second group of the second plurality of output signals and combines the inverted output signals of the second plurality of output signals to provide a second low loudness composite signal having a second low loudness composite frequency characteristic determined by: (a) the frequency band characteristics of those bandpass filters 12 associated with those attenuators 22 from which the second group of the output signals of attenuators 22 are provided, and (b) the individually selected gains of those attenuators 22 from which the second group of the output signals of attenuators 22 are provided. The designation NEG in block 26 indicates that this summing circuit both inverts and sums the second group of the output signals provided by attenuators 22.

The second bipolar equalization circuit further includes a sixth summing circuit 28 for combining the first low loudness composite signal developed by summing circuit 24 and the second low loudness composite signal developed by summing circuit 26 to provide a final low loudness output signal having a final low loudness composite frequency characteristic which is the sum of the first low loudness composite frequency characteristic and the second low loudness composite frequency characteristic. As with the bipolar equalization circuit in the upper half of the drawing, in the second bipolar equalization circuit, the "negative" frequency characteristic, when added to the "positive" frequency characteristic in summing circuit 28, can bring the lower limits down further because the "negative" frequency characteristic is out of phase with the "positive" frequency characteristic, making possible considerably greater variations in the overall frequency characteristic of the hearing aid than possible with state-of-the-art hearing aids.

The compression/expansion circuit also includes means for sensing the loudness level of the audio signal. Such means, represented by the block identified by reference numeral 30, can be a simple rectifying circuit to which the audio signal is supplied and which rectifies the audio signal into a d-c control signal having an amplitude representative of the loudness level of the audio signal.

The compression/expansion circuit further includes means responsive to sensor 30 for sampling the final high loudness composite signal provided by summing circuit 20 and the final low loudness composite signal provided by summing circuit 28 over variable periods of time related to the loudness level of the audio signal to develop a final output signal having an amplitude related to the loudness of the audio signal. Such means, represented by the block identified by reference numeral 32, can be an analog switching arrangement which, in response to the d-c control signal developed by sensor 30, samples the final high loudness composite signal and the final low loudness composite signal over variable periods of time which are determined by the amplitude of the d-c control. This is accomplished by selecting a particular level of the amplitude of the d-c control signal developed by sensor 30 for sampling the final high loudness composite signal and the final low loudness composite signal over equal periods of time, so that when the amplitude of the d-c control signal falls below the selected level, the final high loudness composite signal is sampled over longer periods of time than the sampling time periods of the final low loudness composite signal and when the amplitude of the d-c control signal rises above the selected level, the final low loudness composite signal is sampled over longer periods of time than the sampling time periods of the final high loudness composite signal.

While in the foregoing there have been described preferred embodiments of the present invention, it should be understood by those skilled in the art that various modifications and changes can be made without departing from the true spirit and scope of the present invention.

What is claimed:

1. A bipolar equalizer circuit comprising:

means for supplying an audio signal;

a plurality of bandpass filters each responsive to said audio signal and having a distinct frequency band characteristic which overlaps with adjacent frequency band characteristics for individually passing components of said audio signal having frequencies falling within the frequency band characteristic of the bandpass filter;

a plurality of attenuators each individually associated with one of said plurality of bandpass filters and having an individually selectable gain for individually controlling the amplitude of said components of said audio signal individually passed by the associated bandpass filter to provide a plurality of output signals;

a first summing circuit for combining a first group of said output signals to provide a first composite signal having a first composite frequency characteristic determined by: (a) the frequency band characteristics of those bandpass filters associated with those attenuators from which said first group of output signals are provided, and (b) the individually selected gains of those attenuators from which said first group of output signals are provided;

a second summing circuit for inverting a second group of said output signals and for combining said inverted output signals to rpovide a second composite signal having a second composite frequency characteristic determined by: (a) the frequency band characteristics of those bandpass filters associated with those attenuators from which said second group output signals are provided, and (b) the individually selected gains of those attenuators from which said second group of output signals are provided;

and a third summing circuit for combining said first composite signal and said second composite signal to provide a final output signal having a final composite frequency characteristic which is the sum of said first composite frequency characteristic and said second composite frequency characteristic.

2. A bipolar equalizer circuit according to claim 1 wherein:

(a) all of said attenuators are connected to said first summing circuit, (b) all of said attenuators are connected to said second summing circuit, (c) said first summing circuit includes means for programming said first summing circuit to select which of said output signals are included in said first group of output signals and combined by said first summing circuit, and (d) said second summing circuit includes means for programming said second summing circuit to select which of said output signals are included in said second group of output signals and inverted and combined by said second summing circuit.

3. A compression/expansion circuit comprising:

means for supplying an audio signal;

a plurality of bandpass filters each responsive to said audio signal and having a distinct frequency band characteristic which overlaps with adjacent frequency band characteristics for individually passing components of said audio signal having frequencies falling within the frequency band characteristic of the bandpass filter;

a first plurality of attenuators each individually associated with one of said plurality of bandpass filters and having an individually selectable gain for individually controlling the amplitude of said components of said audio signal individually passed by the associated bandpass filter to provide a first plurality of output signals;

a first summing circuit for combining a first group of said first plurality of output signals to provide a first high loudness composite signal having a first high loudness composite frequency characteristic determined by: (a) the frequency band characteristics of those bandpass filters associated with those attenuators of said first plurality of attenuators from which said first group of said first plurality of output signals are provided, and (b) the individually selected gains of those attenuators of said first plurality of attenuators from which said first group of said first plurality of output signals are provided;

a second summing circuit for inverting a second group of said first plurality of output signals and for combining said inverted output signals of said first plurality of output signals to provide a second high loudness composite signal having a second high loudness composite frequency characteristic determined by: (a) the frequency band characteristics of those bandpass filters associated with those attenuators of said first plurality of attenuators from which said second group of said first plurality of output signals are provided, and (b) the individually selected gains of those attenuators of said first plurality of attenuators from which said second group of said first plurality of output signals are provided;

a third summing circuit for combining said first high loudness composite signal and said second high loudness composite signal to provide a final high loudness output signal having a final composite frequency characteristic which is the sum of said first high loudness composite frequency characteristic and said second high loudness composite frequency characteristic;

a second plurality of attenuators each individually associated with one of said plurality of bandpass filters and having an individually selectable gain for individually controlling the amplitude of said components of said audio signal individually passed by the associated bandpass filter to provide a second plurality of output signals;

a fourth summing circuit for combining a first group of said second plurality of output signals to provide a first low loudness composite signal having a first low loudness composite frequency characteristic determined by: (a) the frequency band characteristics of those bandpass filters associated with those attenuators of said second plurality of attenuators from which said first group of said second plurality of output signals are provided, and (b) the individually selected gains of those attenuators of said second plurality of attenuators from which said first group of said second plurality output signals are provided;

a fifth summing circuit for inverting a second group of said second plurality of output signals and for combining said inverted output signals of said second plurality of output signals to provide a second low loudness composite signal having a second low loudness composite frequency characteristic determined by: (a) the frequency band characteristics of those bandpass filters associated with those attenuators of said second plurality of attenuators from which said second group of said second plurality of output signals are provided, and (b) the individually selected gains of those attenuators of said second plurality of attenuators from which said second group of said second plurality of output signals are provided;

a sixth summing circuit for combining said first low loudness composite signal and said second low loudness composite signal to provide a final low loudness output signal having a final low loudness composite frequency characteristic which is the sum of said first low loudness composite frequency characteristic and said second low loudness composite frequency characteristic;

means for sensing the loudness level of said audio signal;

and means responsive to said sensing means for sampling said final high loudness composite signal and said final low loudness composite signal over variable periods of time related to the loudness level of said audio signal to develop a final output signal having an amplitude related to the loudness of said audio signal.

4. A compression/expansion circuit according to claim 3 wherein:

(a) all of said attenuators of said first plurality of attenuators are connected to said first summing circuit, (b) all of said attenuators of said first plurality of attenuators are connected to said second summing circuit, (c) all of said attenuators of said second plurality of attenuators are connected to said fourth summing circuit, (d) all of said attenuators of said second plurality of attenuators are connected to said fifth summing circuit, (e) said first summing circuit includes means for programming said first summing circuit to select which of said first plurality of output signals are included in said first group of said first plurality of output signals and combined by said first summing circuit, (f) said second summing circuit includes means for programming said second summing circuit to select which of said first plurality of output signals are included in said second group of said first plurality of output signals and inverted and combined by said second summing circuit, (g) said fourth summing circuit includes means for programming said fourth summing circuit to select which of said second plurality of output signals are included in said first group of said second plurality of output signals and combined by said fourth summing circuit, and (f) said fifth summing circuit includes means for programming said fifth summing circuit to select which of said second plurality of output signals are included in said second group of said second plurality of output signals and inverted and combined by said fifth summing circuit.

5. A method for shaping a frequency characteristic for processing an audio signal comprising the steps of:

supplying an audio signal;

separating said audio signal into selected frequency band components;

individually attenuating said selected frequency band components of said audio signal to develop a plurality of output signals;

combining a first group of said output signals to provide a first composite signal having a first composite frequency characteristic determined by: (a) the frequency bands associated with those output signals of said first group of output signals being combined, and (b) the attenuation associated with those output signals of said first group of output signals being combined;

inverting and combining a second group of said output signals to provide a second composite signal having a second composite frequency characteristic determined by: (a) the frequency bands associated with those output signals of said second group of output signals being combined, and (b) the attenuation associated with those output signals of said second group of output signals being combined; and combining said first composite signal and said second composite signal to provide a final output signal having a final composite frequency characteristic which is the sum of said first composite frequency characteristic and said second composite frequency characteristic.

6. A method for shaping a frequency characteristic according to claim 5 wherein:

(a) selection of said output signals which are included in said first group of output signals for combining and setting of attenuation of said selected frequency band components of said audio signal from which said first group of output signals are developed is by programming, and (b) selection of said output signals which are included in said second group of output signals for inverting and combining and setting of attenuation of said frequency band components of said audio signal from which said second group of output signals are to developed is by programming.

7. A method for shaping a frequency characteristic according to claim 5 wherein:

(a) selection of said output signals which are included in said first group of output signals for combining and setting of attenuation of said frequency band components of said audio signal from which said first group of output signals are developed is by trial and error to develop a desired final composite frequency characteristic, and (b) selection of said output signals which are included in said second group of output signals for inverting and combining and setting of attenuation of said frequency band components of said audio signal from which said second group of output signals are developed is by trial and error to develop a desired final composite frequency characteristic.

8. A method for shaping a frequency characteristic for processing an audio signal comprising the steps of:

supplying an audio signal;

separating said audio signal into selected frequency bands;

individually attenuating said selected frequency bands of said audio signal to develop first plurality of output signals;

combining a first group of said first plurality of output signals to provide a first high loudness composite signal having a first high loudness composite frequency characteristic determined by: (a) the frequency bands associated with those output signals of said first group of said first plurality of output signals being combined, and (b) the attenuation associated with those output signals of said first group of said first plurality of output signals being combined;

inverting and combining a second group of said first plurality of output signals to provide a second high loudness composite signal having a second high loudness composite frequency characteristic determined by: (a) the frequency bands associated with those output signals of said second gorup of said first plurality of output signals being combined, and (b) the attenuation associated with those output signals of said second group of said first plurality of output signals being combined; and combining said first high loudness composite signal and said second high loudness composite signal to provide a final high loudness composite signal having a final composite frequency characteristic which is the sum of said first high loudness composite frequency characteristic and said second high loudness composite frrequency characteristic;

individually attanuating said selected frequency bands of said audio signal to develop second plurality of output signals;

combining a first group of said second plurality of output signals to provide a first low loudness composite signal having a first low loudness composite frequency characteristic determined by: (a) the frequency bands associated with those output signals of said first group of said second plurality of output signals being combined, and (b) the attenuation associated with those output signals of said first group of said second plurality of output signals being combined;

inverting and combining a second group of said second plurality of output signals to provide a second low loudness composite signal having a second low loudness composite frequency characteristic determined by: (a) the frequency bands associated with those output signals of said second group of said second plurality of output signals being combined, and (b) the attenuation associated with those output signals of said second group of said second plurality of output signals being combined;

combining said first low loudness composite signal and said second low loudness composite signal to provide a final low loudness composite signal having a final composite frequency characteristic which is the sum of said first low loudness composite frequency characteristic and said second low loudness composite frequency characteristic;

sensing the loudness level of said audio signal; and sampling said final high loudness composite signal and said final low loudness composite signal over variable periods of time related to the loudness level of said audio signal to develop a final output signal having an amplitude related to the loudness of said audio signal.

9. A method for shaping a frequency characteristic according to claim 6 wherein:

(a) selection of said output signals which are included in said first group of said first plurality of output signals for combining and setting of attenuation of said frequency band components of said audio signal from which said first group of said first plurality of output signals are developed is by programming, (b) selection of said output signals which are included in said second group of said first plurality of output signals for inverting and combining and setting of attenuation of said frequency band components of said audio signal from which said second group of said first plurality of output signals are developed is by programming, (c) selection of said output signals which are included in said first group of said second plurality of output signals for combining and setting of attenuation of said frequency band components of said audio signal from which said first group of said second plurality of output signals are developed is by programming, and (d) selection of said output signals which are included in said second group of said second plurality of output signals for inverting and combining and setting of attenuation of said frequency band components of said audio signal from which said second group of said second plurality of output signals are developed is by programming.

10. A method for shaping a frequency characteristic according to claim 6 wherein:

(a) selection of said output signals which are included in said first group of said first plurality of output signals for combining and setting of attenuation of said frequency band components of said audio signal from which said first group of said first plurality of output signals are developed is by trial and error to develop a desired final composite frequency characteristic which is the sum of said first high loudness composite frequency characteristic and said second high loudness composite frequency characteristic, (b) selection of said output signals which are included in said second group of said first plurality of output signals for inverting and combining and setting of attenuation of said frequency band components of said audio signal from which said second group of said first plurality of output signals are developed is by trial and error to develop a desired final composite frequency characteristic which is the sum of said first high loudness composite frequency characteristic and said second high loudness composite frequency characteristic, (c) selection of said output signals which are included in said first group of said second plurality of output signals for combining and setting of attenuation of said frequency band components of said audio signal from which said first group of said second plurality of output signals are developed is by trial and error to develop a desired final composite frequency characteristic which is the sum of said first low loudness composite frequency characteristic and said second low loudness composite frequency characteristic, and (d) selection of said output signals which are included in said second group of said second plurality of output signals for inverting and combining and setting of attenuation of said frequency band components of said audio signal from which said second group of said second plurality of output signals are developed is by trial and error to develop a desired final composite frequency characteristic which is the sum of said first low loudness composite frequency characteristic and said second low loudness composite frequency characteristic.

* * * * *

UNITED STATES PATENT AND TRADE MARK OFFICE

CERTIFICATE OF CORRECTION

PATENT NO. : 5,537,477
DATED : July 16, 1996
INVENTOR(S) : Edouard A. Gauthier et al.

It is certified that error appears in the above-identified patent and that said Letters Patent is hereby corrected as shown below:

Column 7, claim 1, line 3, after "to" delete "rpovide" and insert --provide--.

Column 11, claim 9, line 29, after "claim" delete "6" and insert --8--.

Column 12, claim 10, line 7, after "claim" delete "6" and insert --8--.

Signed and Sealed this

Seventeenth Day of December, 1996

*Attest:*

*Attesting Officer*

BRUCE LEHMAN

*Commissioner of Patents and Trademarks*